United States Patent [19]

Heinemann et al.

[11] 4,450,892

[45] May 29, 1984

[54] METHOD AND APPARATUS FOR CONTINUOUS CASTING OF METALLIC STRANDS IN A CLOSED POURING SYSTEM

[75] Inventors: Wilfried Heinemann, Richterswil, Switzerland; Theodor Rummel, Grünwald/München, Fed. Rep. of Germany

[73] Assignee: Concast, A.G., Zurich, Switzerland

[21] Appl. No.: 278,414

[22] Filed: Jun. 29, 1981

[30] Foreign Application Priority Data

Jul. 11, 1980 [CH] Switzerland ..... 5347/80

[51] Int. Cl.[3] ..... B22D 11/00; B22D 11/10

[52] U.S. Cl. ..... 164/467; 164/440; 164/472; 164/490; 164/503

[58] Field of Search ..... 164/467, 502, 488, 490, 164/505, 440, 439, 472, 503

[56] References Cited

U.S. PATENT DOCUMENTS

| | | | |
|---|---|---|---|
| 3,547,182 | 12/1970 | Roelofs | 164/439 X |
| 3,612,149 | 10/1971 | Rossi | 164/490 X |
| 3,630,266 | 12/1971 | Watts | 164/490 X |
| 3,695,341 | 10/1972 | Soeda et al. | 164/439 X |
| 3,721,287 | 3/1973 | Howle | 164/490 X |
| 3,987,840 | 10/1976 | Birat | 164/490 X |
| 4,146,078 | 3/1979 | Rummel et al. | 164/467 |
| 4,156,451 | 5/1979 | Getselev | 164/467 |
| 4,244,796 | 1/1981 | Rummel et al. | 164/498 X |

FOREIGN PATENT DOCUMENTS

| | | | |
|---|---|---|---|
| 878383 | 8/1971 | Canada . | |
| 1558224 | 12/1973 | Fed. Rep. of Germany . | |
| 52-32824 | 3/1977 | Japan | 164/467 |

*Primary Examiner*—Kuang Y. Lin
*Assistant Examiner*—J. Reed Batten, Jr.
*Attorney, Agent, or Firm*—Wigman & Cohen

[57] ABSTRACT

A method of casting metallic strands in a closed pouring or teeming system wherein the metal is cast through a refractory distributor vessel-pouring structure, such as a pouring spout, into an open-ended mold connected in flow communication with the pouring structure. To improve the quality of the strand and to increase the production capacity or output of such installations at the region of a connection plane of the distributor vessel-pouring structure and the open-ended mold the metallic melt is maintained away from the wall of the mold inlet opening by means of a constricting or bundling electromagnetic field.

13 Claims, 5 Drawing Figures

METHOD AND APPARATUS FOR CONTINUOUS CASTING OF METALLIC STRANDS IN A CLOSED POURING SYSTEM

BACKGROUND OF THE INVENTION

The present invention relates to a new and improved method of, and apparatus for, the continuous casting of metal in a closed pouring or teeming system, wherein the molten metal is cast or teemed through a refractory distributor vessel-pouring structure into an open-ended mold which is operatively connected with the pouring structure. Typically, the pouring structure may be in the form of a pouring tube, nozzle, stud, spout or the like.

During the continuous casting of metal with an open-ended or continuous casting mold the infeed of the molten metal is accomplished either in an open or in a closed pouring or teeming system. As a general rule vertical and arc-type continuous casting installations are operated with open pouring systems, i.e. there is no physical connection between the distributor vessel and the open-ended mold. On the other hand, horizontal continuous casting installations are almost exclusively designed to operate with a closed pouring system. Here, refractory parts of the distributor vessel are connected with the pouring or teeming side of the open-ended or continuous casting mold. The closed pouring system affords at least the following advantages over the open pouring system. Firstly, there is totally eliminated contact of the cast metal with oxygen of the air between the distributor vessel and the open-ended mold. Furthermore, there is dispensed with the need for regulating the level of the molten bath within the mold.

In German Pat. No. 1,558,224, granted Dec. 6, 1973 there is disclosed a horizontal continuous casting installation wherein a distributor vessel is connected with a water-cooled mold. In this arrangement the molten metal flows, without entry of air, out of the distributor vessel into the mold, and the flow velocity of the molten metal is regulated by the withdrawal speed of the strand. It has been found that the liquid metal does not first begin to solidify in the mold, rather already at the region of the connection plane between the mold and the distributor vessel-outlet opening. This results in welding or freezing of metal at the wall of the distributor vessel-pouring structure, typically a pouring tube, and as a consequence of the traction exerted by the withdrawal rolls upon the continuously cast strand there are produced fissures at the already solidified strand circumference. This causes an appreciable disturbance in the casting operation and major material flaws at the finished cast product. Due to fissures being formed at the still thin strand shell or skin at the exit side of the mold it is therefore not possible to eliminate the metal break-out phenomenon, which can lead to complete emptying of the upstream arranged distributor vessel. The welding of the metal within the distributor vessel-outlet opening also leads to rapid destruction of this connection line, so that there is shortened the duration of the casting operation. It is for these reasons that the technique of continuously casting strands particularly with horizontal molds has not found any widespread acceptance in industrial practice, notwithstanding appreciable improvements both as concerns the material and also the design of such connection lines or elements.

Additionally, in U.S. Pat. No. 3,987,840, granted Oct. 26, 1976 there is disclosed a horizontal continuous casting method, wherein the metal is conducted out of a distributor vessel and introduced into the continuous casting mold by means of a refractory, nozzle-like, markedly widening or enlarging connection line. The liquid metal is subjected to electromagnetic forces within such nozzle-like connection line. These electromagnetic forces cause an acceleration of the liquid or molten metal in the flow direction at the circumference of the metallic strand. The pre-formed and accelerated metal flow within the nozzle-like widened or enlarged portion is intended to produce a free ring-shaped space in the briskly enlarged mold cross-section, whereby there should be favored a stable meniscus or bath level. The apparatus for generating the electromagnetic forces along the nozzle-like connection line corresponds to the stator of a linear motor. It is powered by polyphase current and produces a travelling electromagnetic wave. In the free ring-shaped space or annular region there is introduced an inert gas under pressure by means of a multiplicity of slots. The pressure of the inert gas is at least equal to the maximum ferrostatic pressure at such region. Notwithstanding these complicated method steps and also the application of an axial acceleration of the molten metal in the connection line and the pressure impingement in the ring-shaped space, upon standstill of the equipment or in the presence of varying strand withdrawal movements disturbances within the ring-shaped space cannot be completely avoided. Morover, the pressed-in inert gas can be entrained by the moved strand because of the reduced ferrostatic pressure at the strand upper surface in comparison with the lower side or surface of the strand. On the one hand, this can result in additional disturbances arising in the ring-shaped space and, on the other hand, can produce strand defects or flaws, particularly at the surface of the cast strand. Additionally, previously mentioned metal welding phenomenon can arise at the end of the nozzle-like connection line and along therewith the above-mentioned disadvantages.

Also in U.S. Pat. No. 4,146,078, granted Mar. 27, 1979 and U.S. Pat. No. 4,244,796 there have been illustrated, by way of example, equipment and techniques for utilizing electromagnetic forces which act upon molten metal during the casting thereof.

Furthermore, for simultaneously casting a number of strands there has been disclosed in Canadian Pat. No. 878,383, granted Aug. 17, 1971, an arrangement of vertically oriented continuous casting molds which are connected in gas-tight fashion with a common distributor vessel. Here, the molten metal is infed to the continuous casting molds by means of bottom pour nozzles. Between the refractory distributor vessel-pouring spouts or openings and the cooled molds it is possible to selectively operate with or without a gas cushion. With these vertically arranged molds there likewise arise the disturbances known in this technology from the horizontal continuous casting technique between the refractory distributor vessel-pouring spouts and the cooled open-ended mold. Notwithstanding the use of a prolonged pouring nozzle and a gas cushion between the mold and such nozzle metal weld deposits are formed, during varying casting conditions, at the nozzle and such lead to system disturbances. This method has therefore not found acceptance in industrial applications.

SUMMARY OF THE INVENTION

Therefore, with the foregoing in mind, it is a primary object of the present invention to provide a new and improved method of, and apparatus for, the continuous casting of metallic strands in a closed pouring system in a manner not afflicted with the aforementioned drawbacks and limitations of the prior art constructions.

Another and more specific object of the present invention aims at solving with the use of very simple means the heretofore known difficulties which arose at the connection location between a refractory distributor vessel-pouring structure, such as a pouring spout, and a mold, in particular problems such as the metal weld phenomenon, strand flaws, metal break-out and so forth.

Still a further significant object of the invention is directed to devising an economical casting method for multistrand continuous casting installations working with substantially horizontally or vertically arranged molds, which can be supplied with molten metal from a common vessel, typically a tundish, by means of a closed casting or pouring system.

Yet a further significant object of the present invention aims at increasing the output or production capacity of such continuous casting installations by prolonging the possible casting time.

Now in order to implement these and still further objects of the invention, which will become more readily apparent as the discription proceeds, the invention contemplates maintaining the molten melt away from the wall of the mold inlet opening at the region of a connection plane between the distributor vessel-pouring structure and the open-ended mold, through the use of a constricting or melt-pinching electromagnetic field.

As alluded to above the invention is not only concerned with the afore-mentioned method aspects, but further pertains to apparatus for the performance thereof. According to the invention, the apparatus of the present development is manifested by the features that at the region of a connection plane between the distributor vessel-pouring structure and the open-ended mold there is arranged an electromagnetic coil which constricts the metallic melt. It is particularly advantageous if the electromagnetic coil is arranged at the mold-side of the connection plane, i.e. the side of the connection plane confronting or closer to the mold.

The invention renders possible, while utilizing simple process steps and while employing a cost-favorable apparatus, exploiting the advantages of a closed casting system both when continuously casting with vertical and also with horizontal arranged molds. The drawbacks known in this technology, such as metal welding or freezing, strand flaws or defects and metal break-out, can be effectively overcome. By virtue of an appreciably reduced wear in the distributor vessel-pouring structure such as the pouring spout or tube, it is possible to cast longer sequences from the casting ladle, with the attendant beneficial result that there can be appreciably reduced dead-times and maintenance costs. When working with vertically arranged open-ended continuous casting molds the method of the present development enables designing a more simple continuous casting installation, wherein a plurality of strands which are fed from a common distributor vessel and having a smaller mutual spacing between the plural strands, can be driven by a common withdrawal unit and it is only necessary to supervise the bath level or meniscus in the distributor vessel.

A further not yet satisfactorily solved problem with the state-of-the-art closed casting system is constituted by the need to infeed a lubricant into the mold. Hence, according to a further beneficial aspect of the invention it is possible to realize a substantially uniform lubricant infeed in that, while utilizing the vacuum prevailing in the ring-shaped or annular space, there can be introduced into such ring-shaped space a lubricant for the strand. Instead of employing a liquid, pasty or pulverulent lubricant it is possible, for instance, to also introduce a non-oxidizing gas, with or without additives by the action of the vacuum into the ring-shaped space and into the mold, respectively.

An additional reduction in the wear of the refractory distributor vessel-pouring spout can be obtained if, according to a further feature of the invention, the electromagnetic coil is arranged to both sides of the connection plane.

In order to reduce the throughflow velocity of the metal through the distributor vessel-pouring spout or equivalent pouring structure and in order to increase the constricting or bundling effect, the invention further proposes selecting the outlet opening of the distributor vessel-pouring spout and the inlet opening of the mold to be of the same size at the region of the connection plane and additionally retaining the molten metal at a distance from the outlet opening by means of the electromagnetic field.

In the case of vertically arranged molds it can be advantageous if, at the region of the connection plane, the outlet or exit opening of the distributor vessel-pouring spout is smaller than the inlet opening of the mold.

In the case of continuous casting installations having the mold axis oriented approximately vertically or approximately horizontally, it is possible to arrange the electromagnetic coil so as to be dispositioned approximately concentrically with respect to the circumference of the hollow mold compartment or cavity. It is particularly advantageous in the case of horizontal continuous casting installations if the spacing between the electromagnetic coil and the hollow mold compartment below the approximately horizontal lengthwise axis of the open-ended mold is smaller than the spacing of the electromagnetic coil from the hollow mold compartment at a location above the mold lengthwise axis. With such arrangement it is possible to appropriately take into account throughout the height of the strand the differing ferrostatic pressure. According to a further solution for overcoming the drawback of different ferrostatic pressure, it is contemplated by the invention, during the casting of strands having round format or cross-sectional area, to use an oval or an eccentrically arranged circular electromagnetic coil. This electromagnetic coil posseses below the horizontal lengthwise axis of the mold a smaller spacing from the hollow mold compartment than at a location above such lengthwise axis.

According to a further facet of the invention the quality of the strand surface can be improved if there is arranged between the refractory distributor vessel-pouring structure or spout and the continuous casting mold a mold part having a reduced thermal conductivity in relation to that of the continuous casting mold. An additional improvement of the constricting action of the electromagnetic field can be obtained within the hollow mold compartment if the mold part is formed of paramagnetic material possessing an appropriately low thermal conductivity.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
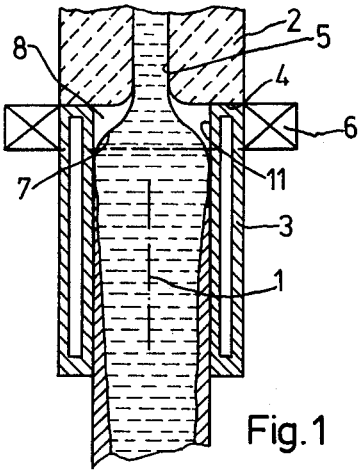
FIG. 1 is a fragmentary vertical sectional view through a distributor vessel-pouring structure, in the form of a pouring spout by way of example, and a throughpass or open-ended mold having an approximately vertically arranged lengthwise axis.

Describing now the drawings, it is to be understood that only enough of the construction of a continuous casting installation has been illustrated in such drawings in order to enable those skilled in the art to readily understand the underlying principles and concepts of the present development. Turning attention now to FIG. 1 there is portrayed therein a refractory distributor vessel-pouring structure 2, here shown in the form of a pouring spout or tube, which is connected with a cooled open-ended or continuous casting mold 3 having an approximately vertically dispositioned mold lengthwise axis 1. The distributor vessel-pouring structure 2 in conjunction with the cooled open-ended mold 3 which is operatively associated with the distributor vessel-pouring structure 2 constitutes a closed pouring or teeming system. Between the open-ended mold 3 and the vessel-pouring structure 2 there is located a connection plane 4. At the moldside of the connection plane 4 there is arranged electromagnetic means comprising an electromagnetic coil 6 which produces a constriction or bundling 7 of the metal, here assumed to be steel, which flows through the continuous or open-ended casting mold 3. Due to the constricting or pinching effect which is produced by the electromagnetic field of the electromagnetic coil 6 there is formed a free ring-shaped or annular space 8, so that at the region of the connection plane 4 the inflowing steel does not come into contact with the walls of the continuous casting mold 3. The vessel-pouring structure 2 constitutes part of a here not further illustrated but conventional distributor or casting vessel. As a general rule, not particularly illustrated but likewise standard support guide elements or roller aprons and a strand withdrawal unit for continuously or intermittently withdrawing the cast strand are arranged following the open-ended mold 3. At the region of the connection plane 4 an outlet or exit opening 5 of the pouring structure or spout 2 is smaller in size than the mold inlet opening 11. At this junction it is mentioned that the invention is not confined to any specific construction of apparatus for producing the electromagnetic pinching or constricting effect since electromagnetic means for exerting electromagnetic forces upon molten metal are well known in this technology, for instance as exemplified by the teachings of U.S. Pat. No. 4,156,451, granted May 29, 1979.

Figure 2:
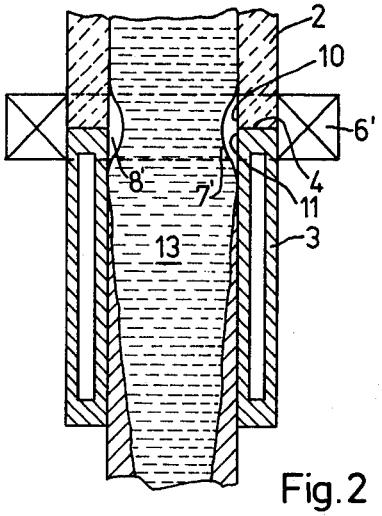
FIG. 2 is a fragmentary vertical section through a further embodiment of a distributor vessel-pouring spout with a mold merging immediately thereafter.

Continuing, the arrangement shown in FIG. 2 conveniently employs the same reference characters as used in FIG. 1 to denote the same or analogous structure. Here, an outlet or exit opening 10 of the distributor vessel-pouring structure 2 is structured at the region of the connection plane 4 to be essentially of the same size as the mold inlet opening 11. Additionally, an electromagnetic coil 6' is arranged to both sides of the connection plane 4. The electromagnetic coil 6' produces once again an electromagnetic field which maintains the molten metal away from the outlet opening 10 of the pouring structure or spout 2. Consequently, here also there is formed a constriction or pinching action, as generally represented by reference character 7', which causes bundling of the molten metal acted upon by the electromagnetic field in a manner such there is prevented contact of the molten metal 13 both at the outlet opening 10 and also with respect to the mold inlet opening 11. The formed ring-shaped or annular space 8' is different in its shape from the ring-shaped space 8 of the arrangement of FIG. 1.

Figure 3:
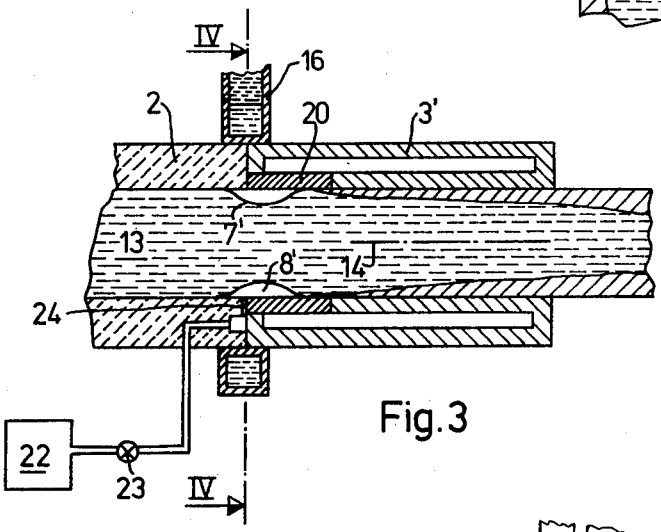
FIG. 3 is a vertical sectional view through a distributor vessel-pouring structure and a continuous casting mold with horizontally arranged lengthwise axis.
Figure 4:
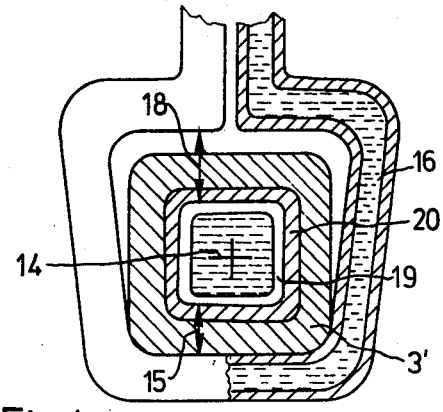
FIG. 4 is a sectional view of the arrangement of FIG. 3 taken substantially along the line IV—IV thereof.

With the horizontal continuous casting installation of FIGS. 3 and 4 the lengthwise axis 14 of an open-ended or continuous casting mold 3' is disposed so as to extend approximately horizontally. The spacing 15 between a water-cooled, electromagnetic single-winding coil 16 and the hollow mold compartment 19 below the horizontal lengthwise axis 14 of the open-ended mold 3' is smaller than the spacing 18 above such lengthwise axis 14. At the inlet side of the continuous casting or open-ended mold 3' there is provided a mold part 20 having a lining which, in relation to the continuous casting mold 3' formed of copper, possesses a reduced thermal conductivity. This lined mold part or lining 20 is advantageously fabricated from a suitable paramagnetic material, such as for instance stainless steel. To ensure that a vacuum does not form in the free ring-shaped space 8', which could counteract the constriction 7', an inert gas is infed from a container or vessel 22 by means of a pressure-reduction valve 23 and through fine infeed means 24, such as infeed slots, into the ring-shaped or annular space 8'. This pressure is approximately accommodated to the atmospheric pressure, and thus, is smaller than the ferrostatic pressure of the molten metal 13. The vacuum prevailing in the ring-shaped space 8' can also be used beneficially for introducing a suitable lubricant into the molten metal producing the cast strand.

Figure 5:
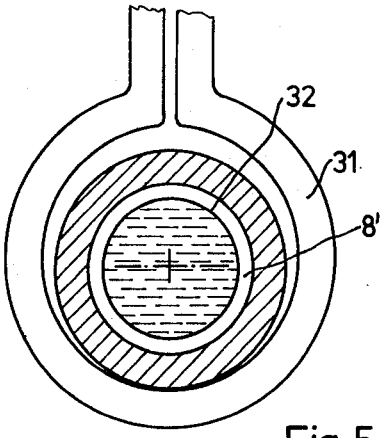
FIG. 5 schematically illustrates a further embodiment of coil arrangement at a continuous casting mold.

Finally, in FIG. 5 there is shown an arrangement employing a slightly oval configured electromagnetic coil 31 which is disposed about a round or circular strand cross-section generally indicated by reference character 32.

The design of the electromagnetic coil and the selection of the power, frequency and so forth, is to be accomplished such that at the region of the connection plane the metallic melt is maintained in spaced relation from the mold wall and/or from the distributor vessel-pouring opening, i.e. the wall of the pouring structure at its exit end, by means of a melt-pinching or melt-constricting electromagnetic field. In order to cast a round strand of 100 mm diameter by means of an apparatus as shown for instance in FIG. 2 it is possible to employ by way of example and not limitation the following parameters:

| | |
|---|---|
| Inner width of the coil: | 150 mm ø |
| Number of windings: | 1 |
| Coil cross-section with internal cooling: | 36 mm × 36 mm |
| Coil material: | Copper |
| Frequency: | 500 Hz |
| Current intensity: | 4500 Amperes |
| Voltage: | 10 Volts |
| Electrical active power: | 34 KW |

In order to cast a square strand of 150 mm×150 mm, by using an apparatus of the type shown in FIGS. 3 and 4 there are recommended the following parameters:

| | |
|---|---|
| Inner width of the coil: | 200 mm × 200 mm |
| Number of windings: | 1 |
| Coil cross-section with internal cooling: | 30 mm × 40 mm |
| Coil material: | Copper |
| Frequency: | 300 Hz |
| Current intensity: | 5000 Amperes |
| Voltage: | 15 Volt |
| Electrical active power: | 52.5 KW |

The inventive method and the apparatus for the performance thereof are basically capable of being beneficially employed in conjunction with a multiplicity of metals. In particular, there also can be cast iron-carbon alloys. Due to the free design possibility of the electrical coil it is possible when utilizing the teachings of the invention that only very few limitations come into play as concerns different strand sectional shapes or format.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A method of continuous casting of metals into a cast strand in a closed pouring system, comprising the steps of:

providing a refractory distributor vessel-pouring structure having an outlet opening;

providing a continuous casting mold having a mold inlet opening bounded by a wall and operatively connected with the distributor-vessel pouring structure, a lengthwise axis which is approximately horizontally disposed and a hollow mold compartment contained in said continuous casting mold;

casting metal through the distributor vessel-pouring structure into the continuous casting mold;

providing an electromagnetic means comprising an electromagnetic coil and arranging said electromagnetic coil such that the spacing between said electromagnetic coil and the hollow mold compartment below the approximately horizontally disposed lengthwise axis of the mold is smaller than the spacing between said electromagnetic coil and the hollow mold compartment above said mold lengthwise axis;

generating by means of said electromagnetic coil a metal-constricting electromagnetic field at the region of a connection plane of the distributor vessel-pouring structure and the continuous casting mold; and said constricting electromagnetic field being effective upon the molten metal in order to maintain the molten metal away from the wall of the mold inlet opening.

2. The method as defined in claim 1, further including the steps of:

selecting at the region of the connection plane the cross-sectional area of the outlet opening of the distributor vessel-pouring structure and the mold inlet opening so as to be essentially of the same magnitude; and maintaining the molten metal away from the outlet opening of the distributor vessel-pouring structure by means of said electromagnetic field.

3. The method as defined in claim 2, further including the steps of:

producing a substantially ring-shaped space which is under vacuum at the region where there is effective said electromagnetic field; and introducing into the ring-shaped space a lubricant for the cast strand while utilizing the vacuum prevailing in said ring-shaped space.

4. The method as defined in claim 1, further including the steps of:

producing a substantially ring-shaped space which is under vacuum at the region where there is effective said electromagnetic field; and introducing into the ring-shaped space a lubricant for the cast strand while utilizing the vacuum prevailing in said ring-shaped space.

5. The method as defined in claim 1, further including the steps of:

producing the electromagnetic field by means of single phase current.

6. The method as defined in claim 1, wherein:

the generated metal-constricting electromagnetic field has a stronger constricting effect in a lower part of the metal flowing through the continuous casting mold than in an upper part of such metal flowing through the continuous casting mold.

7. An apparatus for continuous casting of metals with a closed pouring system, comprising:

a refractory vessel-pouring structure;

a cooled continuous casting mold having a lengthwise axis which is approximately horizontally disposed operatively connected with said refractory vessel-pouring structure at a connection plane;

electromagnetic means comprising an electromagnetic coil arranged at the region of said connection plane between said vessel-pouring structure and said continuous casting mold for constricting the molten metal which is being cast;

said continuous casting mold containing a hollow mold compartment; and said electromagnetic coil being arranged such that the spacing between said electromagnetic coil and the hollow mold compartment below the approximately horizontally disposed lengthwise axis of the mold is smaller than the spacing between said electromagnetic coil and the hollow mold compartment above said mold lengthwise axis.

8. The apparatus as difined in claim 6, wherein:

said electromagnetic coil is arranged at the side of the connection plane confronting the continuous casting mold.

9. The apparatus as defined in claim 6, wherein:

said electromagnetic coil is arranged to both sides of said connection plane.

10. The apparatus as defined in claim 7, wherein:

said electromagnetic coil possesses a substantially oval configuration.

11. The apparatus as defined in claim 7, wherein:

said continuous casting mold is formed of copper;

said continuous casting mold having a mold portion arranged between said refractory vessel-pouring structure and said continuous casting mold which possesses a reduced thermal conductivity in relation to the thermal conductivity of the continuous casting mold.

12. The apparatus as defined in claim 11, wherein:

said mold portion possessing reduced thermal conductivity is formed of paramagnetic material.

13. The apparatus as defined in claim 7, wherein:

said electromagnetic coil is eccentrically arranged with respect to the lengthwise axis of the continuous casting mold such that there is produced a magnetic field having a stronger constricting effect in a lower part of the metal flowing through the continuous casting mold than in an upper part of the metal flowing through the continuous casting mold.

* * * * *